US007261338B2

(12) United States Patent
Spurr

(10) Patent No.: US 7,261,338 B2
(45) Date of Patent: Aug. 28, 2007

(54) SINGLE ACTUATOR POWER CLOSE LATCH MECHANISM WITH FAILSAFE

(75) Inventor: Nigel V. Spurr, Shirley (GB)

(73) Assignee: Meritor Technology Inc., Troy, MI (US)

( * ) Notice: Subject to any disclaimer, the term of this patent is extended or adjusted under 35 U.S.C. 154(b) by 79 days.

(21) Appl. No.: 10/914,305

(22) Filed: Aug. 9, 2004

(65) Prior Publication Data

US 2006/0028029 A1 Feb. 9, 2006

(51) Int. Cl.
*E05C 3/06* (2006.01)
*E05C 17/56* (2006.01)

(52) U.S. Cl. ..... 292/216; 292/201; 292/251.5; 292/DIG. 23

(58) Field of Classification Search ..... 292/201, 292/216, 196, 251.5, 341.16, DIG. 23
See application file for complete search history.

(56) References Cited

U.S. PATENT DOCUMENTS

| | | | | |
|---|---|---|---|---|
| 971,423 | A * | 9/1910 | Walters | 292/201 |
| 1,312,895 | A * | 8/1919 | Derby | 292/201 |
| 2,206,137 | A * | 7/1940 | Tedtman | 292/97 |
| 2,881,021 | A * | 4/1959 | Jacobson | 292/229 |
| 3,504,406 | A * | 4/1970 | Schott | 24/603 |
| 4,395,064 | A * | 7/1983 | Bellot et al. | 292/201 |
| 4,518,180 | A * | 5/1985 | Kleefeldt et al. | 292/201 |
| 4,613,176 | A * | 9/1986 | Kelly | 292/201 |
| 4,906,035 | A * | 3/1990 | Nagai et al. | 292/201 |
| 5,288,037 | A * | 2/1994 | Derrien | 244/102 SL |
| 5,439,262 | A * | 8/1995 | Fuss et al. | 292/341.16 |
| 5,802,894 | A * | 9/1998 | Jahrsetz et al. | 70/264 |
| 5,979,951 | A * | 11/1999 | Shimura | 292/216 |
| 6,378,920 | B1 * | 4/2002 | Ostrowski et al. | 292/216 |
| 6,437,532 | B2 * | 8/2002 | Koerwer | 318/445 |
| 6,520,550 | B2 * | 2/2003 | Kunst et al. | 292/216 |
| 6,811,118 | B2 * | 11/2004 | Collet et al. | 244/102 SL |
| 6,824,176 | B2 * | 11/2004 | Spurr et al. | 292/201 |

* cited by examiner

*Primary Examiner*—Carlos Lugo
(74) *Attorney, Agent, or Firm*—Carlson, Gaskey & Olds

(57) ABSTRACT

A latch mechanism includes a claw rotatable between a latched position and an unlatched position, and an actuator motor. A toggle link that includes a first end, a second end, and a joint between the first end and the second end of the toggle link has one end attached to the actuator motor. The other end of the toggle link interacting with the claw to rotate the claw between the latched position and the unlatched position. A pawl engages the claw when the claw is in a latched position. A release link is attached between the joint of the toggle link and the pawl.

33 Claims, 6 Drawing Sheets

SINGLE ACTUATOR POWER CLOSE LATCH MECHANISM WITH FAILSAFE

FIELD OF THE INVENTION

The present invention relates to a latch mechanism, and in particular, to a single actuator power close latch mechanism with failsafe.

BACKGROUND OF THE INVENTION

There are a number of single motor vehicle closure and release door latch systems in use today. Current single motor closure and release latches require sophisticated actuator motor control with bi-directional operation. In addition, current single motor closure and release latches also require complex mechanisms to achieve the functionality. If power should fail during the operation of current single motor closure and release latches, many latch mechanisms require manual intervention to disengage the power closure actuator. Other latch mechanisms use a centrifugal clutch that disconnects the motor from the mechanism in the event of a power failure. Such latch mechanism systems, however, can give the impression of a secured door due to the potentially high backdrive forces of the actuator. Other latch mechanism systems have no manual release function and do not have any means to manage power failure during closure.

SUMMARY OF THE INVENTION

A latch mechanism includes a claw rotatable between a latched position and an unlatched position, and an actuator motor. A toggle link that includes a first end, a second end, and a joint between the first end and the second end of the toggle link has one end attached to the actuator motor. The other end of the toggle link interacting with the claw to rotate the claw between the latched position and the unlatched position. A pawl engages the claw when the claw is in a latched position. A release link is attached between the joint of the toggle link and the pawl. A release lever is attached to the pawl. The release link is attached to the pawl by way of the release lever. The latch mechanism also includes an electromagnet, and an armature attached to the release lever. The electromagnet is energized to prevent movement of the release lever and the pawl while the latch is in the latched position or while the rotatable claw is moved toward the latched position. The electromagnet is deenergized to move the claw rotatable to an unlatched position. The electromagnet is also deenergized during a power failure. The latch mechanism also includes a release lever attached to the pawl, an armature attached to the free end of the release lever, and an electromagnet located to attract the armature when the electromagnet is carries current. The release link is attached to the pawl by way of the release lever.

The latch mechanism also includes a plate having a guide slot for guiding one of the first and the second end of the toggle link interacting with the claw to rotate the claw. In one embodiment, the latch mechanism further includes an actuator pin for traveling in the guide slot. The actuator pin is attached to the one of the first and the second end of the toggle link interacting with the claw. In some embodiments, the latch mechanism also includes an interlock cam for guiding one of the first and the second end of the toggle link interacting with the claw to rotate the claw during a portion of the path and holding the one of the first and the second end of the toggle link in a rest position when the latch mechanism is in a latched position. The claw further includes a first surface for engaging the pawl, and a second surface for engaging the pawl. In some embodiments, the movement of the actuator motor is controlled by a motor controller. The actuator motor, in some embodiments, includes an actuator lever attached to one of the first and the second end of the toggle link.

A latch mechanism includes a plate having a guide slot, an actuator pin for traveling in the guide slot, and a claw rotatably attached to the plate. The latch mechanism also includes a toggle link having a first end, a second end, and a joint between the first end and the second end. The first end of the toggle link is attached to the actuator pin. The latch mechanism further includes an actuator motor, and an actuator lever attached to the actuator motor and attached second end of the toggle link. The latch mechanism also includes a pawl for engaging the claw in a latched position, and a release link attached between the joint of the toggle link and the pawl. A release lever is attached to the pawl. The release link is attached to the pawl by way of the release lever. The latch mechanism also includes an electromagnet, and an armature attached to the release lever. The electromagnet is energized to prevent the release lever from moving while the latch is in a closed position. The electromagnet is deenergized during a power failure.

A method for latching and unlatching a pawl and a claw of a locking mechanism includes placing a jointed link between an actuator motor and a claw, attaching a lever between a pawl and an electromagnet, linking the jointed link and the lever with a release link, and using the actuator motor to move the jointed link to engage the claw and move the claw from an open position to a closed position. The method further includes holding an end of the lever between the pawl and electromagnet by energizing the electromagnet. Energizing the electromagnet continues while the pawl and claw of the locking mechanism is in a latched position. The method also includes releasing an end of the lever between the pawl and electromagnet by deenergizing the electromagnet. Releasing an end of the lever between the pawl and electromagnet disengages the pawl from the claw and allows the claw to move to an unlatched position.

DETAILED DESCRIPTION OF THE INVENTION

In the following description, reference is made to the accompanying drawings that form a part hereof, and in which is shown by way of illustration specific embodiments in which the invention may be practiced. These embodiments are described in sufficient detail to enable those skilled in the art to practice the invention, and it is to be understood that other embodiments may be utilized and that structural, logical and electrical changes may be made without departing from the scope of the present invention. The following description is, therefore, not to be taken in a limited sense, and the scope of the present invention is defined by the appended claims.

Figure 1:
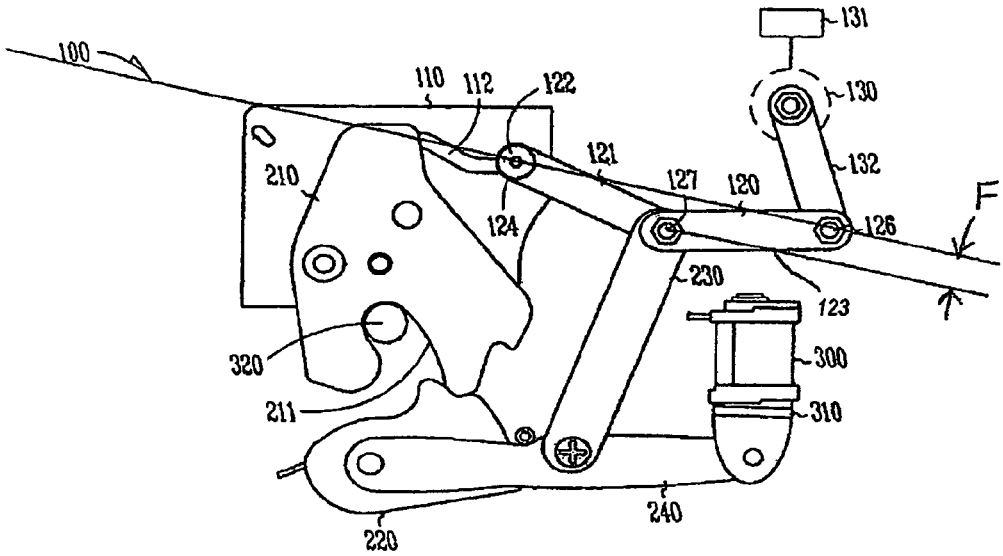
FIG. 1 is a top of a lock mechanism, according to an embodiment of the invention.
Figure 2:
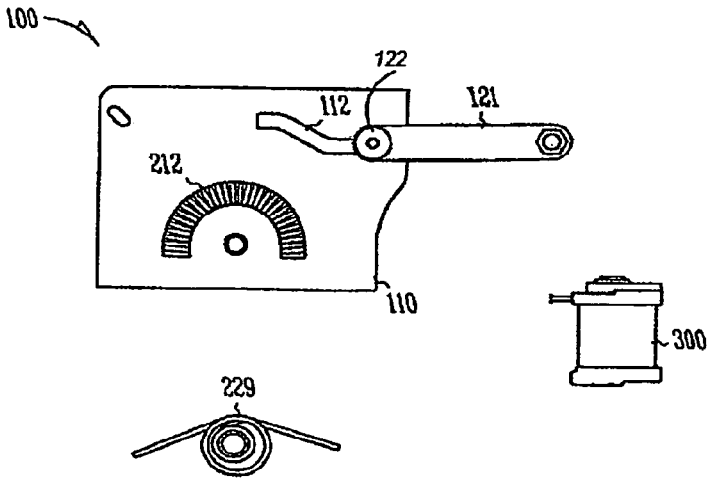
FIG. 2 is a top view of a plate and some of the components attached to the plate of the latch mechanism, according to an embodiment of this invention.
Figure 3:
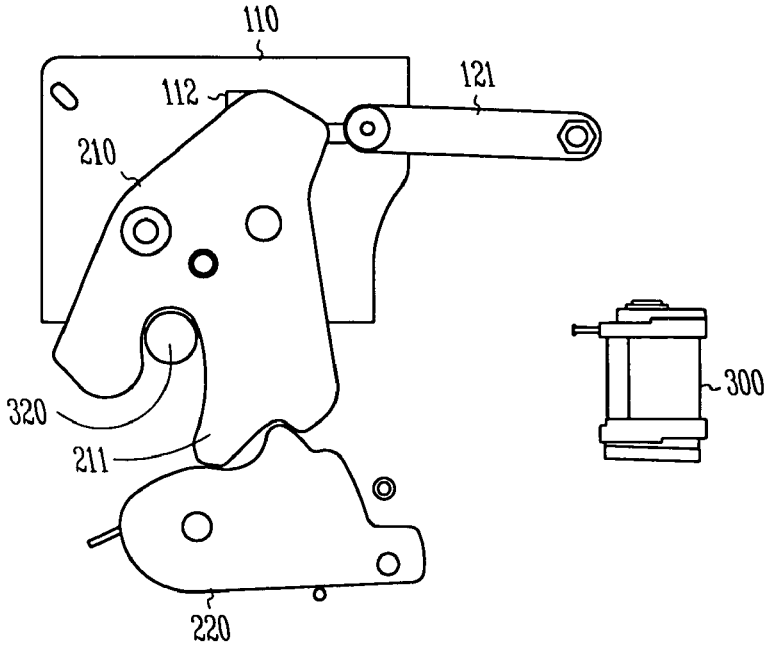
FIG. 3 is a top view of the plate populated with latching or retention components, according to an embodiment of this invention.

FIG. 1 is a top view of a latch mechanism 100, according to an embodiment of this invention. FIG. 2 is a top view of a plate and some of the components attached to the plate of the latch mechanism 100, according to an embodiment of this invention. FIG. 3 is a top view of the plate populated with latching or retention components, according to an embodiment of this invention. Now, referring to each of the FIGS. 1-3, the latch mechanism will be described in further detail. The latch mechanism 100 includes a plate 110 having a guide slot 112 therein. An actuator pin 128 fits within the guide slot 112. The actuator pin 128 is dimensioned so that it can travel along the guide slot 112. Also attached to the plate 100 is a claw spring 212. A claw 210 is rotatably attached to the plate 110. The claw spring 212 urges the claw 210 to a selected position during the operation of the latch mechanism 100. The latch mechanism 100 also includes a toggle link 120. The toggle link has a first rigid section 121 having a first end 124, a second rigid section 123 having a second end 126, and a joint between 127 between the first end 124 and the second end 126. The joint 127 joins the first rigid section 121 and the second rigid section 123 of the toggle link 120. The actuator pin 122 is attached to the first end 124 of the toggle link 120.

The latch mechanism 100 further includes an actuator motor 130. An actuator lever 132 is attached to the actuator motor 130 and attached second end 126 of the toggle link 120. The latch mechanism also includes a pawl 220 for engaging the claw 210 in a latched position. Attached to the pawl 220 is a pawl spring 229. The latch mechanism 100 also includes a release link 230 is attached between the joint 127 of the toggle link 120 and the pawl 220. A release lever 240 is attached to the pawl 220. The release link 230 is attached to the pawl 220 by way of the release lever 240. The latch mechanism 100 also includes an electromagnet 300, and an armature 310 attached to the release lever 240. The electromagnet 300 is energized to prevent the release lever 240 from moving while the latch mechanism 100 is in a closed position. The latch mechanism 100 latches to a pin called a striker 320 (shown in FIG. 1). More specifically, the electromagnet 300 is energized to prevent the release lever 240 from moving while the pawl 220 engages the claw 210 while the claw 210 is in a closed position, surrounding the striker 320 (shown in FIG. 1).

FIGS. 2 and 3 can be thought of as different phases in the assembly of the locking mechanism 100 shown in FIG. 1. FIG. 2 shows, the claw spring 212, the pawl spring 229, and the electromagnet 300. The claw spring 212 is required to ensure that the claw 210 remains in the open position once the striker 320 is withdrawn during opening of the latch mechanism 100. The pawl spring 229 is required to ensure the pawl 220 engages with the claw 210 during a fast closure, such as a door slam, and to insure that the pawl 220 cannot disengage from the claw 210 with a deceleration applied of at least 30 G as required. FIG. 3 adds components that cover some of the components of FIG. 2. FIG. 3 shows the claw 210 moved to the secondary latched position, as required by industry standards, such as FMVSS 206. The pawl 210 is engaged with a notch 211 of the claw.

FIG. 1 shows the toggle link 120, the release lever 240 and actuating lever 132 added to form the locking mechanism 100. Also added in FIG. 1 is an actuator motor 130 that rotates the actuator lever 132. In some embodiments, the actuator motor 130 operates under control of a motor controller 131. The actuator motor 130 is shown in phantom in FIG. 1. The locking mechanism 100 is shown in the rest position. The release lever 240 is in contact with the electromagnet 300 and the claw actuating pin 122 is at the end of the guide slot 112. The toggle offset is clearly shown as dimension F in FIG. 1.

Although all the force transmitting systems are in place, the latch mechanism 100 cannot operate effectively to unlatch since actuator operation will move the actuating pin 122 toward the claw 210. Once the actuator pin 122 contacts the claw 210, further movement of the actuator pin 122 will force the release lever 240 to a position where the armature 310 is out of engagement with the electromagnet 300 and causing the pawl 220 to disengage form the claw 210. However, once the actuator pin 122 is retracted, the pawl 220 may re-engage with the claw 210 since the claw 210 is maintained in the latched position. In addition, the time taken to unlatch is likely to be unacceptable since the actuator pin 122 must contact the claw 210 before a reaction is obtained to unlatch the pawl 220.

Figure 4:
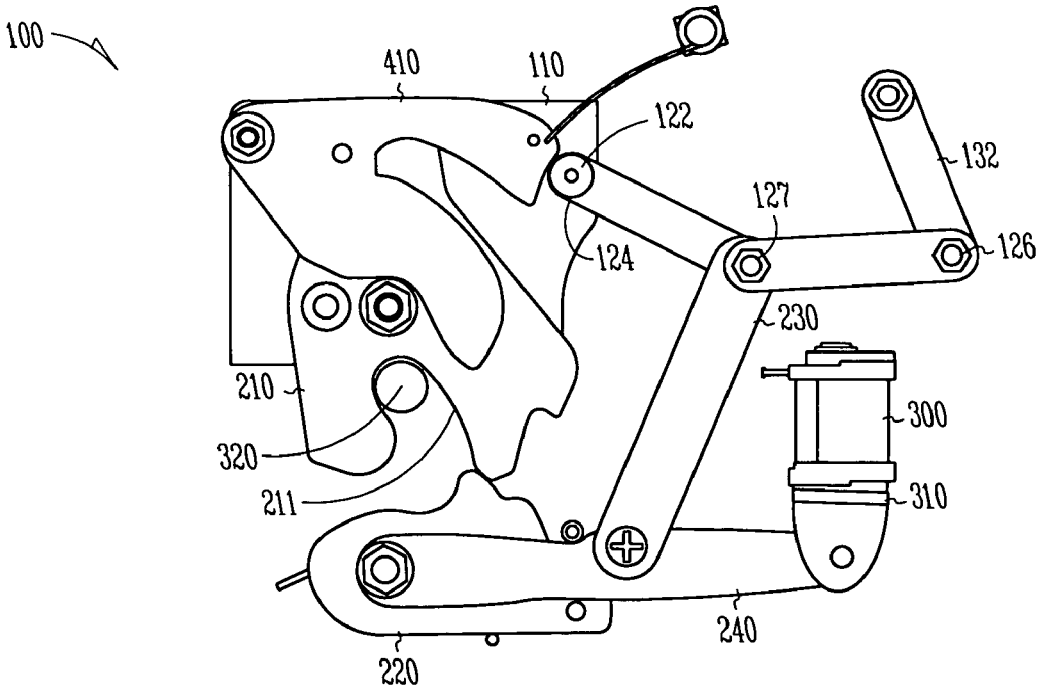
FIG. 4 is a top view of a latch mechanism in a closed position, according to an embodiment of this invention.

To prevent the pawl 220 from re-engaging the claw 210 and to shorten the unlatching time, an interlock cam 410 is added to the latch mechanism 100. FIG. 4 shows a top view of a latch mechanism 100 with the interlock cam 410 added, according to an embodiment of this invention. The various components of the latch mechanism 100 are in the same position as the various components of FIG. 1. Clockwise rotation of the actuator lever 132 will provide an immediate reaction for the toggle offset F of the toggle link 120 to increase and move the pawl 220 from engagement with the claw 210. The force generated on the release link 230 by the toggle offset F must be carefully controlled to ensure that the holding force of the electromagnet 130 is not exceeded during closure of the latch mechanism 100 against a selected force, such as a seal force in a vehicle. The toggle offset F must, however be sufficient to cause the pawl 220 to be disengaged form the claw 210 when required. If the forces are not balanced, lost motion between the release lever 230 and pawl 220 can be introduced to ensure a greater toggle offset F, resulting in greater force applied to the release link 230 before the release lever 240 contacts the pawl 220 to commence unlatching of the latch mechanism 100.

The operation of the latch mechanism 100 will now be discussed. Using the latch mechanism 100, a single actuator motor 130 can achieve power closing and release of a latch that allows failsafe operation should power failure or entrapment occur during the latch closure cycle. No manual control means are required during operation, failsafe or for resetting the system after power loss.

The latch mechanism 100 operates by utilizing the toggle link 120 having a toggle joint 127 between the actuator motor 130 and the load at the actuator pin 122. The toggle link 120 is configured with an offset F that generates a reaction force proportional to the load and offset distance F. The toggle offset reaction force is subsequently used to provide the latch mechanism 100 unlatching means. By permitting the toggle offset F to increase considerably, failsafe operation of the latch mechanism 100 is assured. It should be noted that the latch mechanism 100 is not only useful for latching doors but can also be applied in many other latching environments.

Figure 5:
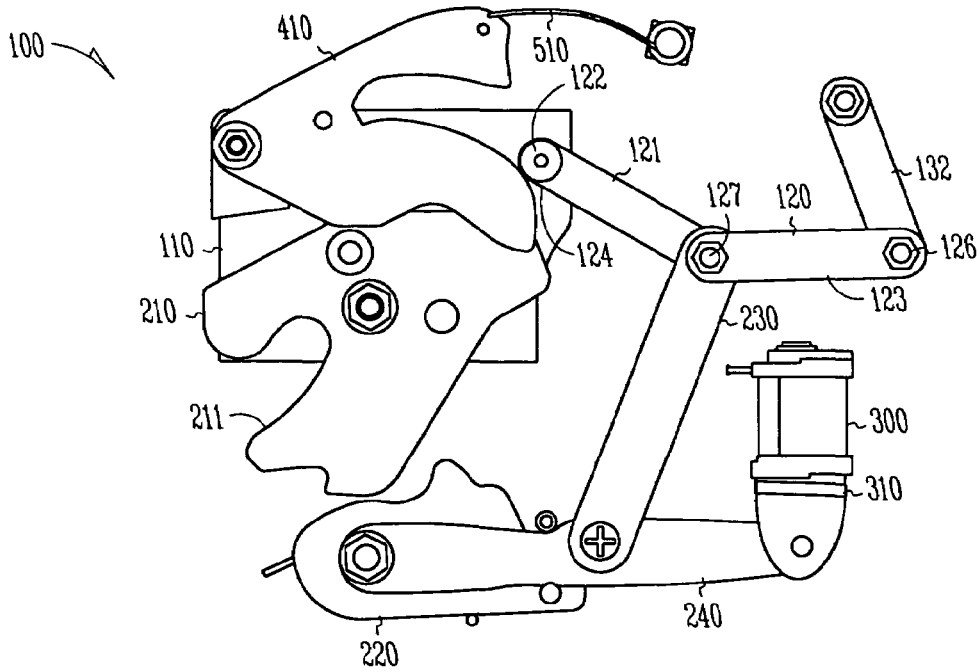
FIG. 5 is a top view of the latch mechanism with the latch in the open position and the actuator lever in the rest position, according to an embodiment of this invention.

FIG. 5 is a top view of the latch mechanism 100 with the latch in the open position and the actuator lever 132 in the rest position, according to an embodiment of this invention. The latch mechanism 100 also includes a bistable spring 510. The bistable spring 510 is required to maintain the interlock cam 410 in the correct position. The interlock cam 410 has two positions. The first position of the interlock cam 410, as shown on FIG. 5, permits the actuating pin 122 to move fully toward the claw 210 (toward the left in FIG. 5) along the guide slot 112 moving the claw 210 to the fully latched position. The position shown in FIG. 4 is required to permit correct unlatching. The bistable spring 510 maintains the interlock cam 410 in the correct position and insures full movement of the interlock cam 410.

Figure 6:
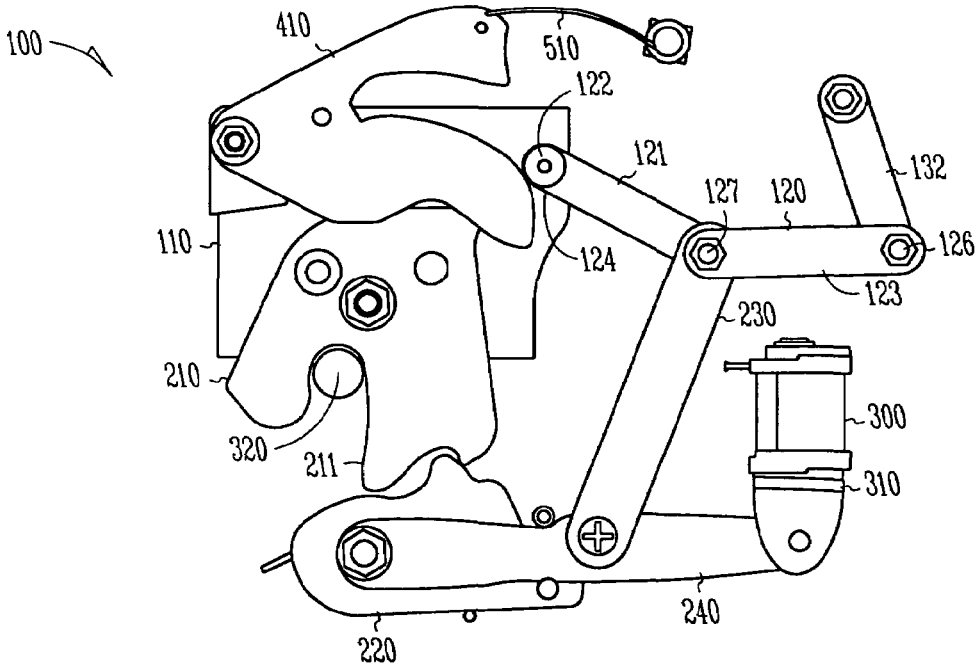
FIG. 6 is a top view of the latch mechanism with the latch in the closed position, according to an embodiment of this invention.

Subsequent operation is best explained by illustrating the operating sequence of the system. FIG. 6 is a top view of the latch mechanism 100 with the latch in the closed position, according to an embodiment of this invention. As the latch mechanism closes, the latch mechanism 100 moves from the open position (FIG. 5) to the closed position (shown in FIG. 6). As shown in FIG. 6, the claw 210 is in the secondary latched position with respect to the claw 220. During closure, a force, due to the toggle offset F shown in FIG. 1, is applied to the release link 230. This force produces a clockwise torque on the pawl 220. The electromagnet 300 attracts the armature 310 attached to the release lever 240 when the electromagnet is energized. The electromagnet 300, acting through the release lever 240, prevents the pawl from rotating. In other words, the force produced by the electromagnet 300 attracting the armature 310 produces a torque around the pawl acting in a counterclockwise direction that counteracts the torque produced on the pawl by the offset F of the toggle link 120. As long as current passes through the electromagnet 300 and the electromagnet remains energized, rotation of the pawl 220 is prevented. The pawl 220 remains in a fixed position as the claw 210 rides over the pawl 220 until a portion of the pawl 220 is positioned within the notch 211 in the claw 210.

Once in the secondary latch position, sensor switches signal the secondary latch position state. The actuator motor 130 operates to rotate the actuator lever 132 clockwise while the electromagnet 300 is energized. The electromagnet 300 holds the release lever 240 in place which in turn prevents the pawl 220 from rotating. The actuator pin 122, guided by the guide slot 112 (shown in FIGS. 1-3) contacts the upper portion of the claw 210 and imparts a counterclockwise rotation on the claw 210. The claw 210 rotates in the counterclockwise direction to the fully latched position. The actuator pin 122 is on the end 124 of the toggle link 120.

Figure 7:
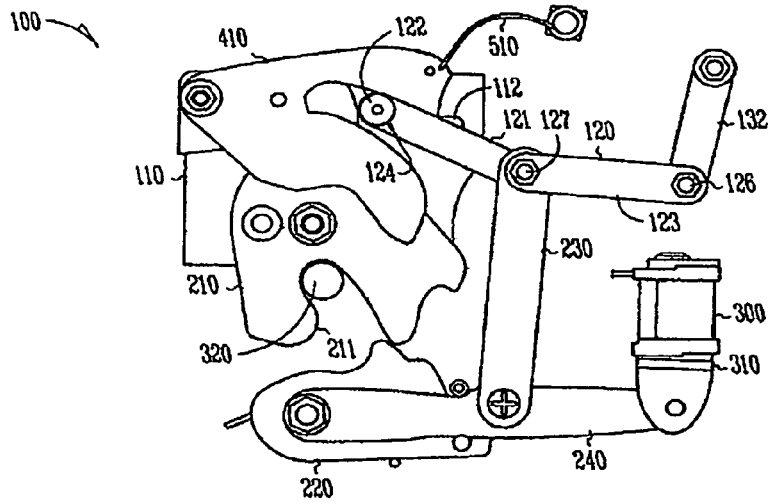
FIG. 7 is a top view of the latch mechanism after the actuator pin has traveled through the slot and imparted a rotational force on the interlock cam, according to an embodiment of this invention.
Figure 9:
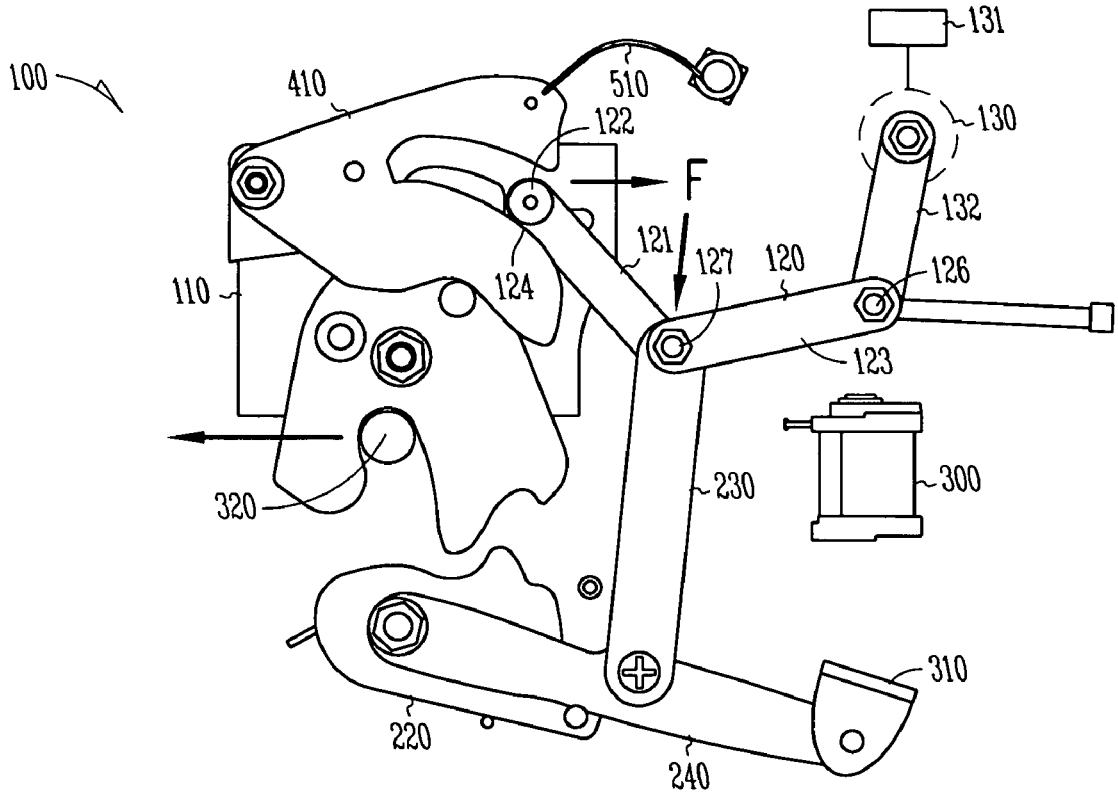
FIG. 9 is a top view of the latch mechanism 100 in the failsafe position, according to an embodiment of this invention.
Figure 10:
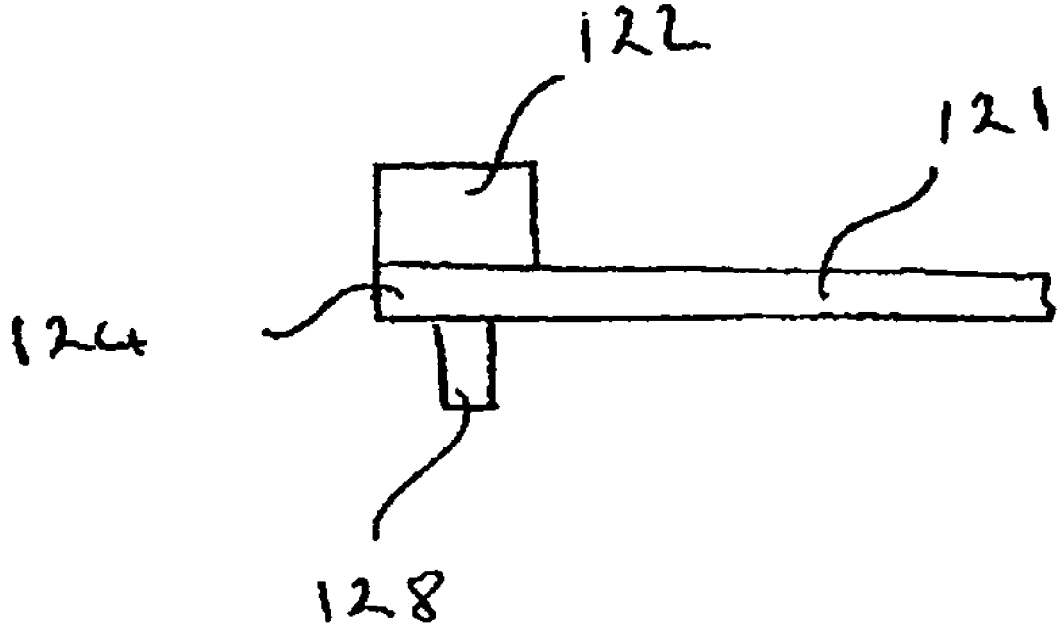
FIG. 10 is a view of the first rigid section.

Concurrently, the interlock cam 410 is rotated clockwise by the actuating pin 122. FIG. 7 is a top view of the latch mechanism 100 after the actuator pin 122 has traveled through the slot 112 and imparted a rotational force on the interlock cam 410, according to an embodiment of this invention. FIG. 7 shows the actuator pin 122 contacting the abutment or upper portion of the claw 210. FIG. 9 also shows the movement of the interlock cam 410 towards the second position of the interlock cam 410. The interlock cam 410 must move at least 60% of its total movement to insure that the bistable spring 510 will urge the interlock cam 510 to the second, clockwise position once the actuator motor 130 and the actuator pin 132 returns to the rest position. Once the latch mechanism is fully latched, sensors detect the fully latched position state and send a signal to the actuator motor 130. The motor controller 131 of the actuator motor 130 signals the actuator motor 130 to reverse direction to the rest position. In some embodiments of the invention, the actuator motor 130 could be configured to complete its operation during a single rotation of its output shaft, eliminating the need to provide a reversal, thus simplifying the control system operated by the motor controller 131.

Once the actuator pin 122 returns, the bistable spring 510 urges the interlock cam 410 to its clockwise position, preventing the actuator pin 122 from moving along the guide slot 112, as shown in FIG. 4.

Figure 8:
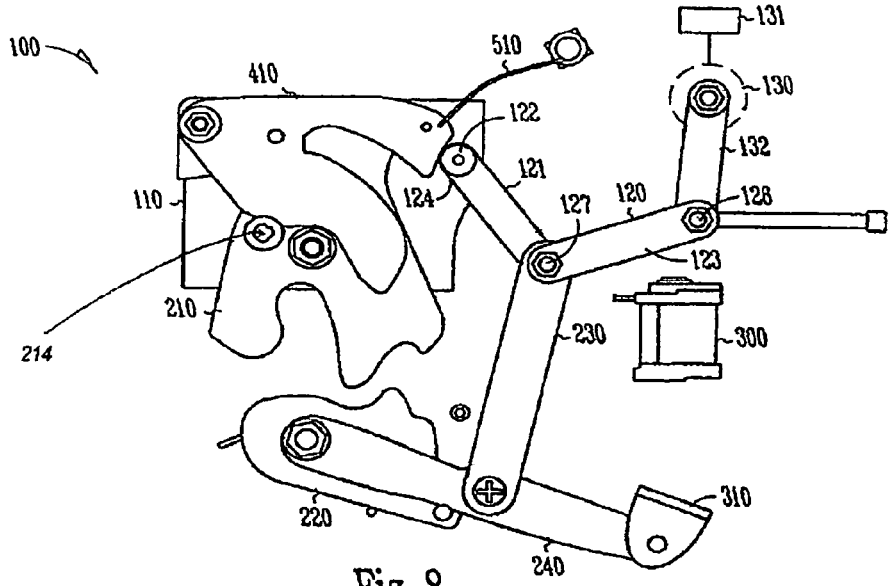
FIG. 8 is a top view of a latch mechanism in the unlatched state, according to an embodiment of the invention.

FIG. 8 is a top view of a latch mechanism 100 in the unlatched state, according to an embodiment of the invention. Turning now to both FIGS. 7 and 8, it is shown that subsequent clockwise rotation of the actuator lever 132 attached to the actuator motor 130 will, due to the toggle offset F of the toggle link 120, apply a force to the release link 230. The force on the release link 230 places a force on the release lever 240 which in turn produces a torque about the pawl 220. The torque about the pawl 220 acts in a clockwise direction to rotate the pawl 220 out of engagement with the claw 210 thereby unlatching the pawl 220 from the claw 210 to unlatch the latch mechanism 100. During unlatching the electromagnet 300 is not energized. When the electromagnet 300 is not energized, the armature 310 attached to the release lever 240 is detached from the electromagnet 300. The electromagnet 300 does not place a force on the release lever 240 so the force produced on the release link 230 by the offset F of the joint 127 of the toggle link 120 produces a torque that disengages the pawl 210 from the claw 220. As a result, the pawl 220 has disengaged form the claw 220, and the claw 220 has moved toward the open position. A pin 214 attached to the claw 210 has contacted the edge of the interlock cam 410. Further counterclockwise rotation of the claw 210, as imparted during door opening, causes the interlock cam 410 to move toward the counterclockwise position as shown in FIG. 5. Return of the actuator lever 132 to its rest position by counterclockwise rotation causes the release lever 230 to rotate in a counterclockwise direction. The release lever 240 rotates in the counterclockwise direction until the armature 310 re-engages the electromagnet 310. The electromagnet 300 is again energized to hold the release lever 240 and the pawl 220 in place so that the latch mechanism 100 can be closed again. In other words, so that the claw 210 can be moved from the open position to a closed position.

The latch mechanism 100 is a failsafe system. A failsafe system insures that even in the event of a power failure during closure of the latching mechanism 100, the latching mechanism will not result in the latch remaining in an unsafe state. The latch can be moved to an unlatched state in the event of a power failure. For example, if the latching mechanism 100 is used on a door, the failsafe system insures that the door can be opened in the event of a power failure. This is achieved by the combination of the toggle link 120 and the electromagnet 300. FIG. 9 (Plate 11) is a top view of the latch mechanism 100 in the failsafe position, according to an embodiment of this invention. During closure of the latch mechanism 100, power is cut and the force produced by the electromagnet 300 (that holds the release lever 240 and the pawl 220 in place) is lost. Rotation of the actuator lever 132 attached to the actuator motor 130 can be assumed to be blocked since the actuator motor 130 uses a worm drive worm gear. In this condition, the force applied to the claw 210 by the striker 320 causes the claw 210 to move to the open position. As the claw moves to the open position, the actuator pin 122 moves and returns to the rest position. Since the actuator lever 132 is blocked from rotating, the toggle link 120 shortens by increasing the toggle offset F at the toggle joint 127. This produces a force in the release link 230 which is placed on the release lever 240. The force on the release lever 240 produces a torque on the pawl 210 to disengage the pawl 220 from the claw 210. The latch mechanism 100 will remain in this open position with the blocked actuator lever 132 until power is restored and the actuator motor 130 returns the actuator lever to the rest position, thus achieving failsafe operation. Similarly, should the vehicle user wish to open the vehicle door during closure if, for example, something is trapped, the usual door unlatching control may be used. This will be configured to cut the power to the electromagnet, causing the actuator motor 130 combined with any load applied to the claw 210 to move the pawl 122 to the unlatched position and effectively shorten the toggle link 120 to permit the latch to open.

This mechanism does not require a mechanical connection to the latch mechanism 100 to disengage the latch from its closed position. The failsafe operation of the latch mechanism 100 permits power closure to be safely applied to latches where no mechanical connection is available between a door handle and the latch.

A method for latching and unlatching a pawl and a claw of a locking mechanism includes placing a jointed link between an actuator motor and a claw, attaching a lever between a pawl and an electromagnet, linking the jointed link and the lever with a release link, and using the actuator motor to move the jointed link to engage the claw and move the claw from an open position to a closed position. The method further includes holding an end of the lever between the pawl and electromagnet by energizing the electromagnet. Energizing the electromagnet continues while the pawl and claw of the locking mechanism is in a latched position. The method also includes releasing an end of the lever between the pawl and electromagnet by deenergizing the electromagnet. Releasing an end of the lever between the pawl and electromagnet disengages the pawl from the claw and allows the claw to move to an unlatched position.

In the foregoing Description of Embodiments of the Invention, various features are grouped together in a single embodiment for the purpose of streamlining the disclosure. This method of disclosure is not to be interpreted as reflecting an intention that the claimed embodiments of the invention require more features than are expressly recited in each claim. Rather, as the following claims reflect, inventive subject matter lies in less than all features of a single disclosed embodiment. Thus the following claims are hereby incorporated into the Description of Embodiments of the Invention, with each claim standing on its own as a separate preferred embodiment.

The invention claimed is:

1. A latch mechanism comprising:
- a claw rotatable between a latched position and an unlatched position;
- an actuator motor; and
- a toggle link including:
  - a first member,
  - a second member, wherein the first member is attached to the second member at a joint, one of the first member and the second member of the toggle link interacts with the claw to rotate the claw between the unlatched position and the latched position, and the other of the first member and the second member of the toggle link is driven by the actuator motor,
  - an offset from a line between distal ends of the first member and the second member and the joint, and
  - a pawl for engaging the claw when the claw is in the latched position,
  - a member for disengaging the pawl from the claw as the offset of the toggle link increases; and
- a system for controlling the offset including an electromagnet and an armature attached to a portion of the latch mechanism, wherein the portion of the latch mechanism controls the offset so as to direct motion from the actuator motor to the claw when the electromagnet is energized.

2. The latch mechanism of claim 1 wherein the system for controlling the offset of the toggle link effects closure of the latch mechanism.

3. The latch mechanism of claim 1 wherein the system for controlling the offset of the toggle link effects unlatching of the latch mechanism.

4. The latch mechanism of claim 1 further comprising a release lever attached to the pawl.

5. The latch mechanism of claim 1 wherein the member for disengaging the pawl includes a release link.

6. The latch mechanism of claim 5 wherein the release link is coupled to the pawl.

7. The latch mechanism of claim 5 further comprising a release lever coupled to the pawl, wherein the release link moves the pawl by moving the release lever.

8. The latch mechanism of claim 1 wherein the armature is engaged with the electromagnet when the electromagnet is energized.

9. The latch mechanism of claim 1 wherein the portion of the latch mechanism does not restrict the offset so as to direct motion from the actuator motor to the pawl when the electromagnet is de-energized.

10. The latch mechanism of claim 5 wherein the system for controlling the offset prevents collapse of the toggle link during a closure cycle.

11. The latch mechanism of claim 10 wherein the system for controlling the offset comprises a release lever that is engaged to the pawl and that is manually released if the latch mechanism is required to open during the closure cycle or if a power failure occurs.

12. The latch mechanism of claim 1 wherein the portion of the latch mechanism is a release lever attached to the pawl, wherein the armature is attached to the release lever.

13. The latch mechanism of claim 12 wherein the electromagnet is energized to prevent movement of the release lever and the pawl while the latch mechanism is being driven to the latched position by the actuator motor.

14. The latch mechanism of claim 12 wherein the electromagnet is energized to prevent movement of the release lever and the pawl as the claw is moved toward the latched position.

15. The latch mechanism of claim 1 wherein the electromagnet is de-energized during a power failure.

16. The latch mechanism of claim 1 wherein the claw is rotatable to the unlatched position when the electromagnet is de-energized during a powered closing cycle.

17. The latch mechanism of claim 12 wherein the claw opens during a power closing by transferring motion from the claw via the toggle link and releasing the release lever and the pawl.

18. The latch mechanism of claim 1 further comprising a member for ensuring the armature is in contact with the electromagnet when the actuator motor is in a rest position.

19. The latch mechanism of claim 1 further comprising a guide feature for guiding one of the first member and the second member of the toggle link that interacts with the claw to rotate the claw.

20. The latch mechanism of claim 19 further comprising a member for transferring force between the toggle link and the claw.

21. The latch mechanism of claim 20 wherein the member for transferring force between the toggle link and the claw comprises an actuator pin for traveling in the guide feature, and wherein the actuator pin, which is attached to the one of the first member and the second member of the toggle link, interacts with the claw.

22. The latch mechanism of claim 1 further comprising an interlock cam for guiding one of the first member and the second member of the toggle link and that interacts with the claw to rotate the claw during a portion of a path and for holding the one of the first member and the second member of the toggle link in a rest position when the latch mechanism is in the latched position.

23. The latch mechanism of claim 1 wherein the claw further comprises a first surface for engaging the pawl and a second surface for engaging the pawl.

24. The latch mechanism of claim 1 wherein movement of the actuator motor is controlled by a motor controller.

25. The latch mechanism of claim 22 wherein the actuator motor further comprises an actuator lever, and the actuator lever is attached to the other of the first member and the second member of the toggle link.

26. A latch mechanism comprising:

a claw rotatable between a latched position and an unlatched position;

an actuator motor;

a toggle link including;

a first member, a second member, wherein the first member is attached to the second member at a joint, one of the first member and the second member of the toggle link interacts with the claw to rotate the claw between the unlatched position and the latched position, and the other of the first member and the second member of the toggle link is driven by the actuator motor, an offset from a line between distal ends of the first member and the second member and the joint, and a pawl for engaging the claw when the claw is in the latched position, a member for disengaging the pawl from the claw as the offset of the toggle link increases;

a release lever attached to the pawl, wherein a release link is attached to the pawl by way of the release lever;

an armature attached to a free end of the release lever; and an electromagnet located to attract the armature when the electromagnet is carrying current.

27. A latch mechanism comprising:

a plate having a guide slot;

an actuator pin for traveling in the guide slot;

a claw rotatably attached to the plate;

a toggle link including:

a first end, a second end, a joint between the first end and the second end, wherein the first end is attached to the actuator pin, an actuator motor;

an actuator lever attached to the actuator motor and attached to the second end of the toggle link;

a pawl for engaging the claw in a latched position, and a release link attached between the toggle link and the pawl.

28. The latch mechanism of claim 27 further comprising a release lever attached to the pawl.

29. The latch mechanism of claim 28 wherein a release link is attached to the pawl by way of the release lever.

30. The latch mechanism of claim 29 further comprising an electromagnet and an armature attached to the release lever.

31. The latch mechanism of claim 30 wherein the electromagnet is energized to prevent the release lever from moving while the actuator motor is driving the latch mechanism to a closed position.

32. The latch mechanism of claim 30 wherein the electromagnet is de-energized during a power failure.

33. The latch mechanism of claim 27 wherein the release link is attached between the joint of the toggle link and the pawl.

* * * * *